US005165613A

United States Patent [19]

Keller

[11] Patent Number: 5,165,613

[45] Date of Patent: Nov. 24, 1992

[54] WEAR RESISTANT SURFACE ARMORING FOR THE ROLLERS OF ROLLER MACHINES, PARTICULARLY OF HIGH PRESSURE ROLLER PRESSES

[75] Inventor: Guenter Keller, Bergisch Gladbach, Fed. Rep. of Germany

[73] Assignee: Kloeckner-Humboldt Deutz Aktiengesellschaft, Fed. Rep. of Germany

[21] Appl. No.: 795,276

[22] Filed: Nov. 20, 1991

Related U.S. Application Data

[63] Continuation of Ser. No. 566,823, Aug. 14, 1990, abandoned.

[30] Foreign Application Priority Data

Aug. 16, 1989 [DE] Fed. Rep. of Germany ..... 3926883

[51] Int. Cl.[5] ..... B02C 4/00

[52] U.S. Cl. ..... 241/235; 241/293; 29/121.1

[58] Field of Search ..... 241/152.2, 227, 235, 241/293; 29/121.1, 121.4, 121.5, 121.6, 121.7, 130, 132

[56] References Cited

U.S. PATENT DOCUMENTS

| | | | |
|---|---|---|---|
| 2,219,085 | 10/1940 | Watson | 241/293 |
| 2,793,585 | 5/1957 | Granitsas | 29/121.4 X |
| 4,357,287 | 11/1982 | Schonert . | |
| 4,703,897 | 11/1987 | Beisner et al. | 241/152 A X |
| 4,733,446 | 3/1988 | Kuroki et al. | 29/121.6 |
| 4,856,161 | 8/1989 | Miihkinen | 29/129.5 |
| 4,996,113 | 2/1991 | Hector et al. | 29/121.4 X |
| 5,042,383 | 8/1991 | Wirz | 29/121.1 X |

FOREIGN PATENT DOCUMENTS

| | | | |
|---|---|---|---|
| 616189 | 3/1961 | Canada | 241/293 |
| 0084383 | 6/1986 | European Pat. Off. . | |
| 2311555 | 12/1976 | France | 241/152 A |
| 425643 | 2/1975 | U.S.S.R. | 241/152 A |

OTHER PUBLICATIONS

Profiled roll presses 11-302 sales brochure KHD Humbold Wedag Welded-on roll profiles.

*Primary Examiner*—Mark Rosenbaum
*Assistant Examiner*—Frances Chin
*Attorney, Agent, or Firm*—Hill, Van Santen, Steadman & Simpson

[57] ABSTRACT

Wear-resistant armoring on the outer surface of a roller for a high pressure roller press capable of interparticle crushing of granular material wherein the armoring is composed of axially extending welding beads horizontally welded along the roller either without spacing from one another or with slight spacing.

7 Claims, 1 Drawing Sheet

FIG. 1
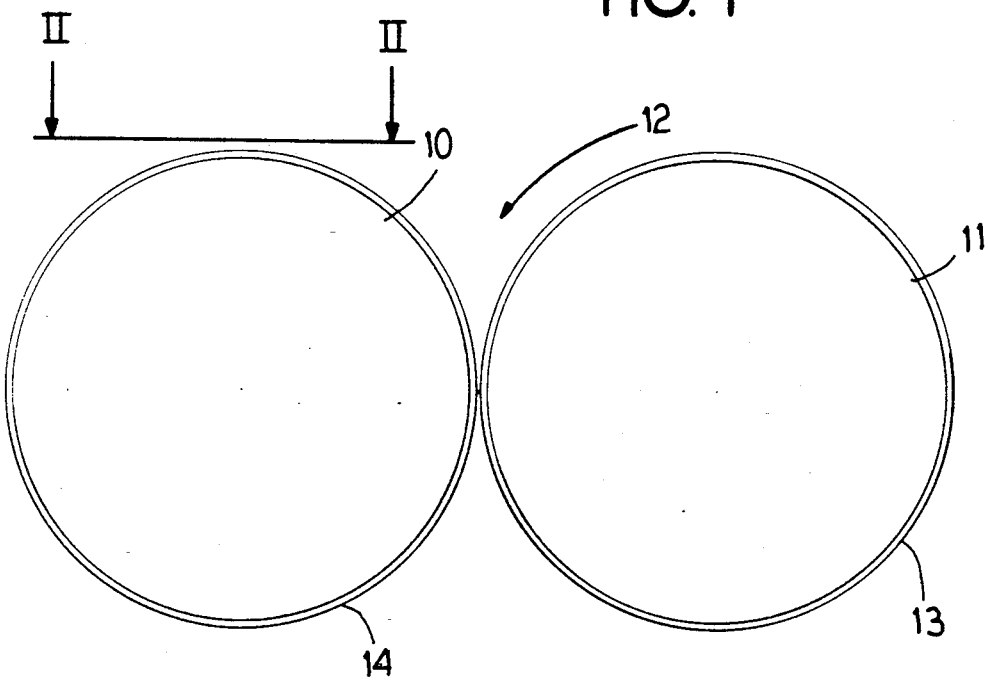
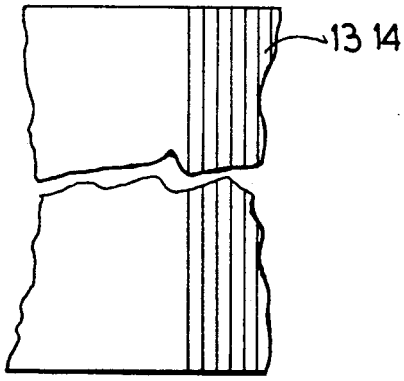
FIG. 2
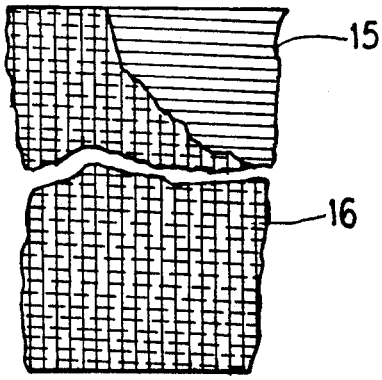
FIG. 3

WEAR RESISTANT SURFACE ARMORING FOR THE ROLLERS OF ROLLER MACHINES, PARTICULARLY OF HIGH PRESSURE ROLLER PRESSES

This is a continuation of application Ser. No. 566,823, filed Aug. 14, 1990, now abandoned.

BACKGROUND OF THE INVENTION

The present invention relates to improvements in roller presses, and more particularly to an improved roller construction and method of making the roller which provides surface armoring particularly for high pressure roller presses for pressure comminution of granular material operating as interparticle crushing presses.

In roller presses and crushers, brittle grinding stock is drawn into the nip and is subjected to pressure comminution. What is referred to as interparticle crushing in the nip of a high pressure roller press is also known as product bed comminution wherein the individual particles of the grinding stock are drawn into the nip by friction to crush one another in a product bed with the application of extremely high pressure.

The concept of the invention may be used in the original manufacture of rollers but is particularly well suited to provide a coating on the existent core of a roller that is not otherwise modified. The invention is applicable in two roller presses, but is particularly well suited in roller presses for interparticle crushing because of the high nip forces involved.

The concept of interparticle crushing involves a process wherein the bulk material is stressed between two practically nonyielding hard surfaces generally with a compression of at least 500 kg per square centimeter to result in energy sufficiently high not only to cause comminution but to cause a distinct agglomeration on briquetting of the particles whereafter the resulting agglomerates are disintegrated by further mechanical stressing in a separate device. Interparticle crushing, sometimes called product bed comminution is discussed in various prior art patents including U.S. Pat. Nos. 4,357,287 and 4,703,897 and European Patent 0 084 383. In the structures and processes of these patents, individual particles of the grinding stock are drawn into the nip by friction to crush one another upon the application of extremely high pressure in a product bed wherein the material fill is compressed between two roller surfaces. It will be evident that the roller surfaces are thereby exposed to extraordinarily high stress and wear.

It has been known to armor roller surfaces by welding layers of hard metallic materials onto the base roller cylinder. In such constructions, a one-part or a multi-part wear-resistant cladding of cast or rolled material is joined onto the base roller. The roller armor is welded on and has been constructed by welding annular layers lying side-by-side.

In order to improve the draw-in capability of the nip of pressing rollers, it must draw the product into the nip by friction and compress it. It is known to provide the cylindrical surface of the roller jacket with a profiling of beads arrange V-shaped and which are attached by additional manufacturing steps. Due to the creation of trough-shaped washouts in the region between the welding beads of the profiling welded on the roll, it had been shown that the. roller surfaces wears relatively quickly.

It is accordingly an object of the present invention to provide an improved roller for a high pressure roller press which has wear-resistant armoring on the surface which is constructed in a simplified fabrication method and has a high useful life despite profiling and particularly has a good product draw-in capability in the nip.

A further object of the invention is to provide an improved roller press wherein the rollers are capable of operating under particle crushing circumstances and wherein the rollers are armored and have good draw-in capabilities.

FEATURES OF THE INVENTION

In accordance with the features of the invention, the roller armoring on the high pressure roller has at least an outermost welding ply of armoring. The welding is constructed by welding beads lying annularly side-by-side, but is produced by welding beads lying transversely or axially relative to the roll and are arranged horizontally side-by-side along predetermined lines of the roller. The transverse or axial welding beads are preferably welded without a spacing from one another but at least with a spacing of less than 40 mm from one another. With this construction, the interspaces between the transverse welding beads, which have proven unfavorable in structures heretofore available, are eliminated.

Even when transverse welding ribs are welded on without a spacing from one another, the roller profiling considerably improves the product draw-in capability of the two roller nip. As compared with opposed smooth rollers, the transverse welded pattern provides a long useful life due to the natural rounding of the welding beads in the transverse roller direction.

When the armoring is constructed with at least the outermost welded-on armoring layer comprised of transverse welding beads, this construction has made the additional manufacturing step of welding on V-shaped roller profilings unnecessary. Welding single-layer or multi-layer transverse welding beads onto the inner layers of the roller armoring raises no difficulties even when the inner layers are comprised of single-layer or multi-layer annular layers that are radially welded on or are comprised of helical weldings.

The outermost roller armoring layer produced in a welding layer or a plurality of welding layers lying on top of one another can preferably comprise a thickness of up to 4 mm. There is also the possibility of fashioning the roller armoring produced by the transverse welding beads projecting further at several locations distributed over the roller circumference than at the remaining locations of the roller circumference.

By welding onto the roller horizontally disposed transverse welding beads, it is also possible to use annular welding beads lying transversely relative thereto to produce a network shaped rotor or profiling having a mesh width that is less than 40 mm.

The material of the transverse welding beads can be comprised of a metallic alloy utilizing special carbide and nitride forming agents. Such material is disclosed, for example, in German Patent Application P 39 26 232.4 which corresponds to U.S. application, Ser. No. 411,026, filed Sep. 22, 1989, Scholz et al. In the surface armoring of the roller in accordance with the construction herein described, the armor layers, at least the transverse welding beads that form the outermost layers, at least may be welded on with a submerged filler band arc surfacing. In filler band surfacing, the alloy constituents are filled in powder form such as into a flat hollow band comprised of soft iron. The actual alloy does not arise until during the welding process. As a result of the filler band surfacing, a uniform distribution of the alloy of the armor material and a uniform structuring of the welding beads are achieved.

Other objects, features and advantages will become more apparent with the teaching of the principles of the invention in connection with the disclosure of the preferred embodiments in the specification, claims and drawings, in which:

DESCRIPTION OF THE DRAWING

FIG. 1 illustrates opposed rollers of a high pressure roller press operating in the interparticle crushing mode and constructed in accordance with the principles of the present invention;

FIG. 2 is a fragmentary view taken substantially along line II—II of FIG. 1; and FIG. 3 is a fragmentary plan view taken substantially along line II—II of FIG. 1 and illustrating a modified embodiment of the invention.

DESCRIPTION OF THE PREFERRED EMBODIMENTS

FIG. 1 Figure of the drawings shows two counter-rotating rolls 10 and 11 which are supported for rotation and driven in rotation. The rollers have heavy bearings and pressure equipment so as to be able to operate with interparticle crushing. The outer surfaces of the roller have practically nonyielding hard surfaces and generally generate a compression in a nip 12 of least 500 kg per square centimeter to result in energy sufficiently high not only to cause comminution but to cause a distinct agglomeration or briquetting of the particles passing through the nip. This results in interparticle crushing, sometimes called product bed comminution as referred to above.

The rollers each have on their outer surfaces horizontal weld beads 13 or 14 extending axially in side-by-side relationship. The welding beads have a spacing from one another no greater than 40 mm.

The weld beads 13 and 14 provide an armoring and may be composed of a metallic alloy having hard substances such as carbides or special carbides. In one form, the transverse welding beads are welded by submerged filler band arc surfacing to provide the wear-resistant armoring. This results in a good draw-in capacity in the nip 12. A plurality of layers may be used for the armoring 13 and 14 which is comprised of at least one layer of weld beads but may be a plurality of layers. In one form, the armoring is provided by the submerged filler band arc process wherein a flat hollow band encircles the roll filled with the alloy constituents in powder form and the welding beads are added to the outer surface so that a uniform distribution of the alloy of the armor material is achieved.

As illustrated in FIGS. 2 and 3 in another form, on the outer surface of the roll, an inner layer of armoring may be provided with the inner layers comprised of welded on annular layers lying side-by-side in an endless helical welding as illustrated at 15 in FIG. 3. In some instances there may be provided an outer layer of axially extending welds 16 to form a network with the axially extending welds on the outer surface over the welds 15. This forms a network obtaining the advantages above set forth, particularly of good drawn-in faculties for the nip formed between opposed rollers.

Thus, it will be seen that there has been provided an armored roller structure which achieves the objectives and advantages above set forth and avoids disadvantages present in the prior art.

I claim as my invention:

1. A roller for a high pressure roller press cable of operating in an interparticle crushing press comprising in combination:

a cylindrical metal press roller having a circumferential surface;

a layer of armoring on the surface of the roller;

and said roller having an outer layer on the armoring layer formed by welding beads projecting radially from the outer layer and lying axially side-by-side to form an uneven profile, said welding beads having an axial spacing from one another or less than 40 mm.

2. A roller for a high pressure roller press capable of operating in an interparticle crushing press constructed in accordance with claim 1:

wherein the material of the welding beads is composed of a metallic alloy having hard substances in the structure on the order of carbides.

3. A roller for a high pressure roller press capable of operating in an interparticle crushing press constructed in accordance with claim 1:

wherein the welding beads are welded on by a submerged filler band arc surfacing.

4. A roller for a high pressure roller press capable of operating in an interparticle crushing press constructed in accordance with claim 1:

wherein said welding beads are formed by an axially extending helical endless welding line.

5. A roller for a high pressure roller press capable of operating in an interparticle crushing press constructed in accordance with claim 1:

wherein the welding beads have a thickness ranging up to a maximum of 4 mm.

6. A roller for a high pressure roller press capable of operating in an interparticle crushing press constructed in accordance with claim 1:

wherein the welding beads include a layer of annular welds and a layer of axially extending welds to form a network.

7. A roller press capable of operating in an interparticle crushing press comprising:

first and second cylindrical metal rollers forming a press nip therebetween having sufficient nip pressure for interparticle crushing and for drawing one another in product bed comminution;

and each roller having an outer circumferential surface having a layer of armoring on the surface of each roller and an outer layer on the armoring layer formed by welding beads projecting radially from said outer circumferential surface and lying axially side-by-side to form an uneven profile, said welding beads having an axial spacing from one another of less that 40 mm.

* * * * *